US012766658B2

(12) United States Patent
Chen et al.

(10) Patent No.: US 12,766,658 B2
(45) Date of Patent: Oct. 20, 2026

(54) PROCESS FOR POLISHING AND GRINDING COPPER FOIL SURFACE FOR REDUCING ROUGHNESS THEREOF

(71) Applicant: Taichi Metal Material Technology Co., Ltd., Tainan (TW)

(72) Inventors: Kuan-Wei Chen, Tainan (TW); Kuan-Yu Chen, Tainan (TW); Jason Shian-Ching Jang, Tainan (TW)

(73) Assignee: Taichi Metal Material Technology Co., Ltd., Tainan (TW)

( * ) Notice: Subject to any disclaimer, the term of this patent is extended or adjusted under 35 U.S.C. 154(b) by 342 days.

(21) Appl. No.: 18/610,477

(22) Filed: Mar. 20, 2024

(65) Prior Publication Data

US 2024/0316718 A1 Sep. 26, 2024

(30) Foreign Application Priority Data

Mar. 23, 2023 (TW) ..... 112110816

(51) Int. Cl.

| | |
|---|---|
| ***B24B 7/12*** | (2006.01) |
| ***B24B 7/22*** | (2006.01) |
| ***B24B 37/04*** | (2012.01) |
| ***B24B 37/08*** | (2012.01) |
| ***B24B 57/04*** | (2006.01) |

(52) U.S. Cl.

CPC ..... *B24B 7/12* (2013.01); *B24B 7/22* (2013.01); *B24B 37/042* (2013.01); *B24B 37/08* (2013.01); *B24B 57/04* (2013.01)

(58) Field of Classification Search

CPC ..... B24B 7/12; B24B 7/22; B24B 37/042; B24B 37/08; B24B 57/04; B24B 1/00; B24B 29/06; B24B 41/007; B24B 41/047; B24B 7/17; B24B 7/06; B24B 7/24; B24B 7/241; B24B 7/242; B24B 7/244; B24B 7/26; B24B 55/12; B24D 3/002; B24D 13/02

See application file for complete search history.

(56) References Cited

U.S. PATENT DOCUMENTS

| | | | | |
|---|---|---|---|---|
| 3,277,609 | A * | 10/1966 | Horie | B24B 7/12 451/28 |
| 4,318,199 | A * | 3/1982 | Kunz | B24B 29/005 451/110 |
| 5,468,174 | A * | 11/1995 | Bachand | B24C 9/006 451/92 |
| 2020/0063226 | A1* | 2/2020 | Chen | B22F 7/08 |

* cited by examiner

*Primary Examiner* — Monica S Carter
*Assistant Examiner* — Christopher Soto
(74) *Attorney, Agent, or Firm* — Demian K. Jackson; Jackson IPG PLLC

(57) ABSTRACT

A process for polishing and grinding a copper foil surface comprises implementing a main roller made of soft, porous, fibrous and compressible materials, and placing a plurality of metallic-glass particles injected, impinged or applied to the peripheral surface of the main roller, whereby upon rotation of the main roller to contact and brush the copper foil surface, each metallic-glass particle as cushioned by the main roller may simultaneously polish and grind the copper foil surface for efficiently reducing roughness of copper foil.

4 Claims, 2 Drawing Sheets

PROCESS FOR POLISHING AND GRINDING COPPER FOIL SURFACE FOR REDUCING ROUGHNESS THEREOF

BACKGROUND OF THE INVENTION

In a conventional method for reducing roughness of copper foil surface, ceramic particles or powders are used for polishing the copper foil surface. However, the ceramic particle has an acute edge which may easily scratch or break the copper foil to cause short circuit of a circuit board, thereby affecting the production yield and quality of the copper foil.

The present inventor has found this drawback and invented the present process for gently brushing, polishing, and grinding the copper foil surface for efficiently reducing the surface roughness of copper foil.

SUMMARY OF THE INVENTION

The object of the present invention is to provide a process for polishing and grinding a copper foil surface by implementing a main roller made of soft, porous, fibrous and compressible materials, and placing a plurality of metallic-glass particles injected, impinged or applied to the peripheral surface of the main roller, whereby upon rotation of the main roller to contact and brush the copper foil surface, each metallic-glass particle as cushioned by the main roller may simultaneously polish and grind the copper foil surface for efficiently reducing roughness of copper foil.

DETAILED DESCRIPTION

Figure 1:
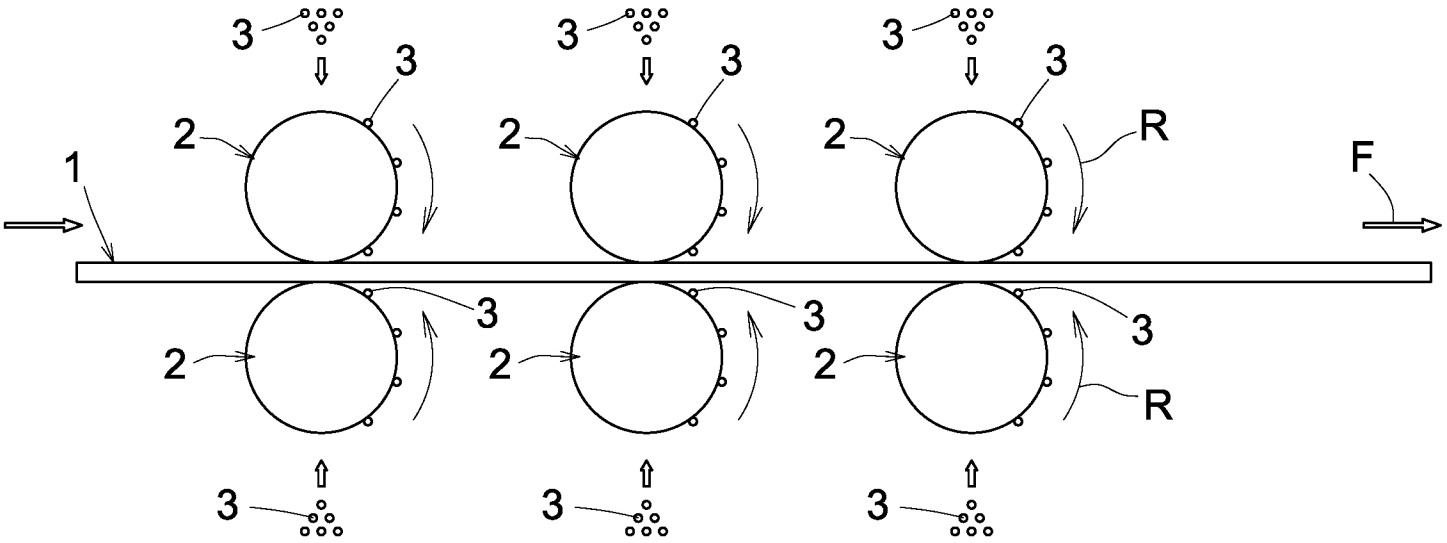
FIG. 1 shows a flow sheet for polishing a copper foil of the present invention.
Figure 2:
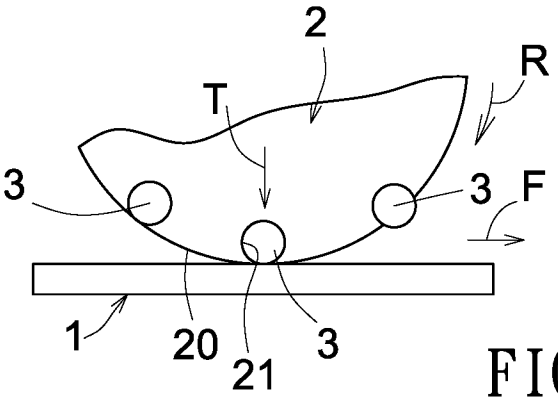
FIG. 2 shows the metallic-glass particle, when cushioned by the main roller, is polishing the copper foil in accordance with the present invention.

As shown in FIGS. 1 and 2, the present invention comprises: implementing a main roller 2, which is made of soft, porous, fibrous and compressible materials for brushing a copper foil 1; and placing a plurality of metallic-glass particles 3 to be injected, impinged, or applied to a peripheral surface 20 of the main roller 2 to allow each metallic-glass particle to be partially received in the peripheral surface 20 of the main roller 2, and to protrude an upper portion of the metallic-glass particle 3 outwardly as cushioned by the main roller 2, whereby upon rotation of the main roller 2 to contact the copper foil surface 20, the copper foil surface will be brushed by said main roller, and each said metallic-glass particle 3, as compressed in the main roller to restore a restoring elastic force T, will be urged outwardly by the restoring elastic force T from the main roller 2 to forcibly polish and grind the copper foil surface, thereby simultaneously and cooperatively brushing, polishing and grinding the copper foil surface for efficiently reducing roughness of the copper foil.

It is very essential for the role of each metallic-glass (MG) particle 3 in the present invention as hereinafter described:

1. Each MG particle 3, having high roundness approaching a perfect circle, will be rotatably received in a cavity 21 formed in the main roller 2. So, each MG particle 3 may be rotatable to well polish and grind the copper foil surface, without scratching or breaking the copper foil surface. Also, the metallic-glass particle has a high hardness and strength, better for the polishing and grinding.
2. Each metallic-glass particle 3 may be inferentially considered as a "daughter roller" in cooperation with the main roller 2, which may be considered as a "mother roller". Both "mother roller" and "daughter rollers" simultaneously brush, polish and grind the copper foil surface to thereby efficiently reduce the roughness of the copper foil surface.
3. The main roller 2, as made of soft, porous, fibrous and compressible materials may allow each metallic-glass particle 3 to be injected, impinged, sprayed or applied into the peripheral surface of the main roller to be forcibly received in a cavity 21 temporarily formed in situ in the main roller 2. The main roller 2 has a plurality of pores, which are provided for "catching" or receiving the metallic-glass particles 3 as injected.

The main roller 2 may be made of: cotton roller, nylon roller, wool roller, sponge roller, foam roller and porous roller made of elastomeric materials.

In FIG. 1, a plurality of roller sets, each consisting of a main roller 2 and a plurality of metallic-glass particle 3 carried on the main roller 2, are provided on both upper side U and lower side D of the copper foil 1.

An unwound roller (not shown) may be provided for releasing the copper foil 1 to be polished. A wind-up roller (not shown) may be provided for winding up the polished copper foil 1. This is the Roll-to-Roll process.

The copper foil 1 is pulled forwardly in direction F, while each roller 2 is driven in a direction R as shown in FIG. 1.

The rollers 2 may also be arranged on an upper side or a single side of the copper foil 1.

When the main roller 2 is driven and rotated in direction R as shown in FIG. 2, the metallic-glass particle 3, normally protruding outwardly from the peripheral surface 20 of the main roller 2, may be retracted or depressed inwardly when the main roller 2 tangentially touching the copper foil 1. Meanwhile, the metallic-glass particle 1, when retracted to compress the main roller 2, a restoring elastic force T may exert as restored by the compressed main roller 2. Such a restoring force T will then urge the metallic-glass particle outwardly to forcibly polish and grind the copper foil surface. Please be noted that the main roller 2 is made of compressible materials as aforesaid.

Thanks to the round or circle metallic-glass particle 3. The particle 3 will be rotatably received in and cushioned by the main roller 2, like a universal roller, will thoroughly homogeneously grind and polish the copper foil surface.

The metallic-glass particle 3 is rotatable, not deadly fixed, in main roller 2, allowing its free rotation, and thereby enhancing a smooth grinding and polishing motion on the copper foil surface, without injuring, scratching or breaking the copper foil. Also, each metallic-glass particle 3 is cushioned by the soft, compressible main roller 2. The main roller 2 serves as a shock-absorbing medium to absorb any unexpected impacting force during the grinding and polishing for further preventing injury to the copper foil surface.

An applicator or feeder (not shown) may be provided to inject, impinge or form the metallic-glass particles 3 onto the main roller 2.

A collector or a vacuum sucker (not shown) may be provided to collect or suck the metallic-glass particles 3 from the production line for re-use of the metallic-glass particles.

Figure 3:
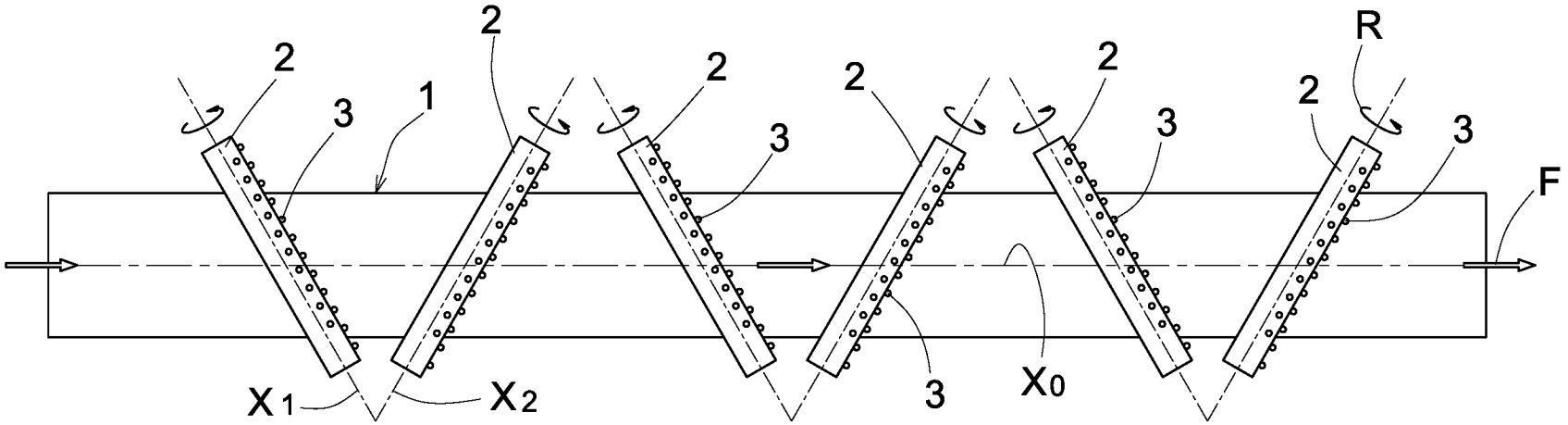
FIG. 3 shows different orientations of the main rollers when polishing copper foil of the present invention.

As shown in FIG. 3, each main roller 2 may have its longitudinal axis $X_1$ or $X_2$ to be arranged to be projectively inclinedly intersected with the main axis $X_0$ defined in a longitudinal center of the copper foil 1 in the production line. Therefore, the polishing and grinding in the copper foil surface may be homogeneously achieved. An inclined angle of each main roller 2 as projectively intersected with the main axis $X_0$ of the copper foil is not limited to this invention.

The particle size of MG particle may range from 5 microns to 50 microns, but not limited.

The present invention is superior to the conventional methods, with the following advantages:

1. The process is dry polishing and grinding, without using polishing liquid, to thereby prevent oxidation or corrosion on the copper foil surface.
2. The main roller 2 and the metallic-glass particles 3 are actuated for brushing, polishing ad grinding the copper foil surface simultaneously, thereby efficiently reducing the roughness of the copper foil.
3. Round or circle-like metallic-glass particle 3 with shiny smooth surface is rotatably carried on the main roller 2 to make the polishing and grinding more gentle without scratching or breaking the copper foil, without being influenced by the intrinsic high hardness and high strength of the metallic-glass particle.

We claim:

1. A process for polishing and grinding a copper foil surface comprising: implementing at least a main roller, which is made of soft, porous, fibrous and compressible materials for brushing a copper foil; and placing a plurality of metallic-glass particles to be injected, impinged, or applied to a peripheral surface of the main roller to allow each said metallic-glass particle to be rotatably received in the peripheral surface of the main roller, and to protrude an upper portion of each said metallic-glass particle outwardly as cushioned by the main roller, whereby upon rotation of the main roller to contact the copper foil surface, the copper foil surface will be brushed by said main roller, and each said metallic-glass particle, as compressed in the main roller to restore a restoring elastic force, will be urged outwardly by the restoring elastic force from the main roller to forcibly polish and grind the copper foil surface, thereby simultaneously and cooperatively brushing, polishing and grinding the copper foil surface for efficiently reducing roughness of the copper foil.

2. The process according to claim 1, wherein each said main roller is selected from the group consisting of: a cotton roller, a nylon roller, a wool roller, a sponge roller, a foam roller, and a porous roller made of elastomeric materials.

3. The process according to claim 1, wherein a collector including a vacuum sucker is provided for collecting or sucking the metallic-glass particles for re-use.

4. The process according to claim 1, wherein each said main roller has a longitudinal axis, which is arranged to be projectively inclinedly intersected with a main axis defined in a longitudinal center of said copper foil.

* * * * *